US011597636B2

(12) United States Patent
Peters

(10) Patent No.: US 11,597,636 B2
(45) Date of Patent: Mar. 7, 2023

(54) MOBILE CRANE WITH TWO-PART JIB, AND METHOD FOR ALIGNING THE BOOM SYSTEM OF SUCH A MOBILE CRANE

(71) Applicant: LIEBHERR-WERK EHINGEN GMBH, Ehingen/Donau (DE)

(72) Inventor: Stefan Peters, Huettisheim (DE)

(73) Assignee: LIEBHERR-WERK EHINGEN GMBH, Ehingen/Donau (DE)

( * ) Notice: Subject to any disclaimer, the term of this patent is extended or adjusted under 35 U.S.C. 154(b) by 44 days.

(21) Appl. No.: 17/040,493

(22) PCT Filed: Mar. 21, 2019

(86) PCT No.: PCT/EP2019/057141
§ 371 (c)(1),
(2) Date: Sep. 22, 2020

(87) PCT Pub. No.: WO2019/180167
PCT Pub. Date: Sep. 26, 2019

(65) Prior Publication Data

US 2021/0024335 A1 Jan. 28, 2021

(30) Foreign Application Priority Data

Mar. 22, 2018 (DE) ..... 10 2018 106 753.4

(51) Int. Cl.
*B66C 23/82* (2006.01)

(52) U.S. Cl.
CPC ..... *B66C 23/823* (2013.01)

(58) Field of Classification Search
CPC ..... B66C 23/82; B66C 23/821; B66C 23/823; B66C 23/825
See application file for complete search history.

(56) References Cited

U.S. PATENT DOCUMENTS 3,080,068 A * 3/1963 Felkner ..... B66C 23/70 212/177

FOREIGN PATENT DOCUMENTS

| | | | |
|---|---|---|---|
| CN | 1839090 | A | 9/2006 |
| CN | 101423180 | A | 5/2009 |
| CN | 102408071 | A | 4/2012 |
| CN | 102502430 | A | 6/2012 |
| DE | 3640068 | A1 | 7/1987 |
| DE | 19731587 | A1 | 1/1999 |

(Continued)

OTHER PUBLICATIONS

Machine Translation JPH-10316366A (Year: 1998).*

(Continued)

*Primary Examiner* — Michael R Mansen
*Assistant Examiner* — Juan J Campos, Jr.
(74) *Attorney, Agent, or Firm* — McCoy Russell LLP

(57) ABSTRACT

The invention relates to a mobile crane with a two-part jib and to a method for aligning the boom system of such a mobile crane. The invention relates to a mobile crane with a multi-part flight boom, wherein a first jib part is hinged to the main boom in a rockable manner, and at least one second jib part is secured to the first jib part in an articulated manner. A bracing which is guided from the upper chassis to the jib is provided for aligning the jib, said bracing running over at least one intermediate bracing support mounted on the first jib part to the at least one second jib part.

16 Claims, 5 Drawing Sheets

Fig. 5

(56) References Cited

FOREIGN PATENT DOCUMENTS

| | | | |
|---|---|---|---|
| DE | 202007008990 | U1 | 11/2008 |
| DE | 102007051539 | A1 | 5/2009 |
| EP | 2253577 | A1 | 11/2010 |
| EP | 2431322 | A1 | 3/2012 |
| JP | H10316366 | A | 12/1998 |
| JP | 2008044724 | A | 2/2008 |
| WO | 2005021415 | A1 | 3/2005 |

OTHER PUBLICATIONS

Machine Translation CN-102502430A (Year: 2012).*
ISA European Patent Office, International Search Report Issued in Application No. PCT/EP2019/057141, dated Jul. 1, 2019, WIPO, 6 pages.

* cited by examiner

MOBILE CRANE WITH TWO-PART JIB, AND METHOD FOR ALIGNING THE BOOM SYSTEM OF SUCH A MOBILE CRANE

CROSS-REFERENCE TO RELATED APPLICATIONS

The present application is a U.S. National Phase of International Patent Application Serial No. PCT/EP2019/057141 entitled "MOBILE CRANE WITH TWO-PART JIB, AND METHOD FOR ALIGNING THE BOOM SYSTEM OF SUCH A MOBILE CRANE," filed on Mar. 21, 2019. International Patent Application Serial No. PCT/EP2019/057141 claims priority to German Patent Application No. 10 2018 106 753.4 filed on Mar. 22, 2018. The entire contents of each of the above-referenced applications are hereby incorporated by reference for all purposes.

TECHNICAL FIELD

The invention relates to a mobile crane having a multipart fly boom, wherein a first fly boom part is luffably connected to the main boom in an articulated manner and at least one second fly boom part is fastened to the first fly boom part in an articulated manner. A guying extending from the superstructure up to the fly boom serves the raising of the fly boom.

BACKGROUND AND SUMMARY

There are already systems having fly booms that can be split to set up a mobile crane having a fly boom in tight space conditions. Substantial space can be saved due to the splitting capability or folding capability of the fly boom. In addition, the foldability of the fly boom makes it possible to carry out all the required manual assembly work from the ground.

FIG. 1 shows such a mobile crane having a foldable fly boom. The mobile crane comprises a main boom in the form of a telescopic boom 1 that is luffable by means of luffing rams. A fly boom 2 is luffably installed at the tip of the main boom 1. This fly boom 2 consists of two fly boom parts 2*a*, 2*b* that are as a rule connected to one another via a joint 3*a* and a closure element 3*b*. A guying 4 is guided from the superstructure of the mobile crane along the main boom 1 over raising frames 6 up to the free end of the first fly boom part 2*a* and is fastened there.

The raising of the fly boom 2 is implemented via the guying 4 in that the length of the guying 4 between the superstructure and the raising frames is regulated by means of a winch. The front part 2*b* of the fly boom 2, also called a cantilever boom, is drawn downward by gravity on raising, whereby the total fly boom 2 closes and a loadable connection is thus produced at the separation point. Since the second fly boom part 2*b* should pivot into the required position by gravity, it is not possible to guide the guying 4 over the total length of the fly boom 2 up to the head of the second fly boom part 2*b* and to fasten it there. If the guying 4 were actually fastened to the outer end of the fly boom 2, the fly boom 2*b* would fold through the center pivot point 3*a* instead of extending.

However, this would equally have the consequence that the front part 2*b* of the fly boom 2 is not guyed during normal load work and is thereby loaded very much to bend under load. Due to this kind of loading, considerably less payload can be achieved in comparison than with a system having guying that would reach up to the head of the fly boom 2.

A new possibility is therefore sought for the guying of a fly boom that knows how to overcome the previously described problems.

This object is achieved by a mobile crane in accordance with the features of claim 1. Advantageous embodiments of the mobile crane are the subject of the dependent claims.

Starting from the mobile crane of the category, it is proposed to guide the guying not only up to the outer end of the first fly boom part, but rather instead up to at least a second fly boom part, ideally up to the head of the total fly boom. This is made possible by at least one intermediate guying frame which is installed at the first fly boom part and by which the force of the guying can be applied to at least a large part to the first fly boom part during the raising of the fly boom part. It is thereby further ensured that the at least one second fly boom part can pivot into the required closure position to connect the boom parts due to gravity during the raising process.

After the raising process, a complete guying of the fly boom is theoretically possible, whereby the maximum payload of the boom system can be increased. The intermediate guying frame can comprise at least one compressively rigid bar. The fly boom can be a lattice boom.

In operation, the intermediate guying frame is ideally perpendicular to the boom axis; the intermediate guying frame in particular projects perpendicular upwardly in a horizontal position of the fly boom; the guying then extends up to the free tip of the intermediate guying frame. The intermediate guying frame can, however, also project from the fly boom at a different angle than 90°. At 90°, the largest lever arm can be achieved with the mass used; however, sufficient lever arms can also be achieved with smaller angles. Angles in the range between 80° or 85° or even lower are conceivable.

Care must be taken under certain circumstances during the raising process of the fly boom that the intermediate guying frame has torque rigidity to be able to apply sufficient force to the first fly boom part. Torque rigidity in this connection in particular means that the intermediate guying frame may not be moved or pivoted to the rear in the direction of the main boom relative to the first fly boom part by the force of the guying during the raising procedure. This can be done either by a fixed or torque-rigid direct attachment of the guying frame to the fly boom or can, alternatively, be ensured by additional auxiliary means that fix the guying frame in the desired position. The last variant makes an articulated attachment of the guying frame to the fly boom part possible to be able to move it into a space saving position for transport purposes. A releasable fastening of the guying frame to be able to dismantle it completely for transport is naturally also conceivable. The aforesaid torque-rigid alignment of the intermediate guying frame can be achieved by at least one additional intermediate frame guying that so-to-say counteracts the guying force. Such a separate frame guying is ideally installed at the free end of the intermediate guying frame and is, on the other hand, connected to the first fly boom part, with this connection point naturally being closer to the free end of the first fly boom part than the assembly point of the intermediate guying frame. In accordance with a possible solution, the frame guying and the intermediate guying frame form a so-called double crank whose geometrical shape effects the desired torque rigidity of the intermediate guying frame. Alternatively, the work of the frame guying could equally be taken over by a support at the oppositely disposed side of the intermediate guying frame at the first fly boom part, i.e. it is arranged closer to the main boom than the intermediate guying frame. The important thing is only the achieving of a torque-rigid position of the intermediate guying frame.

The assembly of the intermediate guying frame at the first fly boom part is not necessarily restricted to a specific installation location. However, an installation of the intermediate guying frame at or close to the end of the first fly boom part, i.e. in the region of the join for the at least one fly boom part, is ideal. An assembly of the intermediate guying frame at the top flange of the first fly boom part is preferred.

In mobile cranes of the category, such a fly boom is preferably composed of lattice pieces. To be able to provide a universal intermediate guying frame for different fly boom types, it is particularly advantageous for the intermediate guying frame to be variable in size, which can preferably be implemented by suitable adjustment means. The length of the intermediate guying frame, i.e. the achievable distance of the guying with respect to the longitudinal boom axis, is of particular importance. Ideally, use is made of a suitable telescopic mechanism as the adjustment means that permits a simple and inexpensive length variation of the intermediate guying frame. The intermediate guying frame can specifically be formed by one or more pipes supported in one another and displaceable relative to one another. They can be bolted together at different points to implement a flexible length adjustment.

It is sensible and necessary for an embodiment having a separate frame guying likewise to equip it with suitable adjustment means to be able to adapt them to different length settings of the intermediate guying frame.

The fastening of the guying to the intermediate guying frame can, for example, take place by bolting. The guying can be implemented by individual stay poles that are fixedly bolted at the end side to the raising frames and/or to the intermediate guying frame. A rope guying or similar would equally be conceivable.

At least one latching device is provided in the region of the join between the first fly boom part and the at least one second fly boom part, said latching device providing a sufficient locking or latching of the join on a closure of the join of the bottom flange caused by gravity. The join is ideally automatically latched as soon as the connection points of the fly boom part engage into one another. The additional latching additionally secures the join against an engaging tension such as can occur on an unforeseen load failure.

The latching device is preferably seated in the region of the join between both fly boom parts, ideally at the second fly boom part, and comprises, in accordance with a preferred embodiment, at least one latch that automatically engages around a bolt of the complementary fly boom part on a connection closure and thus effects a sufficient latching of the two boom parts.

In addition to the mobile crane in accordance with the invention, the present invention also relates to a method of raising the boom system in a mobile crane of the present invention. In accordance with the invention, this method is characterized by the following steps:

a) Assembly of the first fly boom part, including the raising frames at the main boom, the guying, and the intermediate guying frame at the first fly boom part;
b) luffing up of the main boom and assembly of the additional guying or stay poles;
c) minimal luffing up of the fly boom and assembly of the at least one second fly boom part and fastening of the additional guying to the head part of the fly boom; and
d) luffing the fly boom up to the geometrical closing of the latch connection between the fly boom parts.

The aforesaid worksteps only require manual assembly processes that can take place with a luffed down boom system close to the ground. No additional safety measures are accordingly required for assembly work at a great height. A complete guying of the two-part fly boom can furthermore be provided by the integration of the intermediate guying frame in later crane operation.

The head of the fly boom, i.e. the free end of the at least one second fly boom part, is pulled over the ground in the direction of the main boom during the raising procedure. It is sensible for this purpose for the head of the fly boom to be placed on a roller or on a suitable trolley.

On a use of an intermediate guying frame to be assembled in an articulated form at the fly boom, it additionally has to be fixed in a torque-rigid manner by a separate frame guying prior to the minimal luffing up of the fly boom. This can be implemented, for example, by forming a double crank.

BRIEF DESCRIPTION OF THE FIGURES

Further advantages and properties of the invention will be explained in more detail in the following with reference to an embodiment shown in the Figures. There are shown.

FIG.: a detail view of the latching device for the join between the fly boom parts.

DETAILED DESCRIPTION

Figure 1:
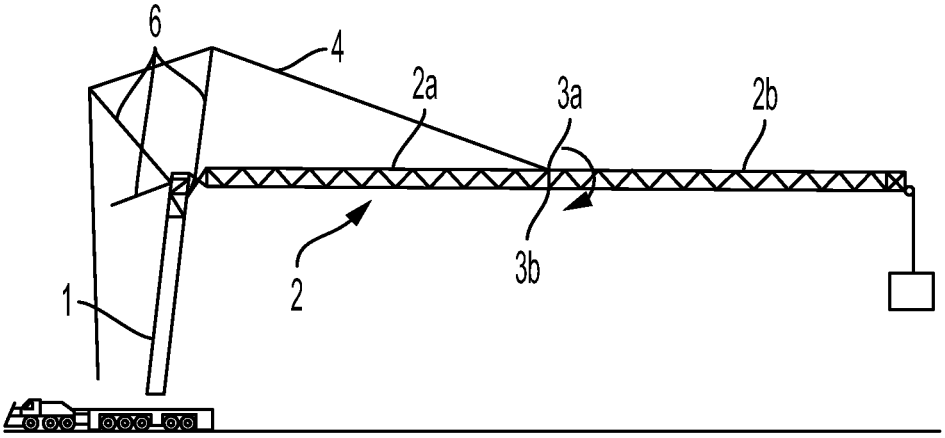
FIG. 1 PRIOR ART
FIG. 1: a sketched side view of a conventional mobile crane having a foldable fly boom.
Figure 2:
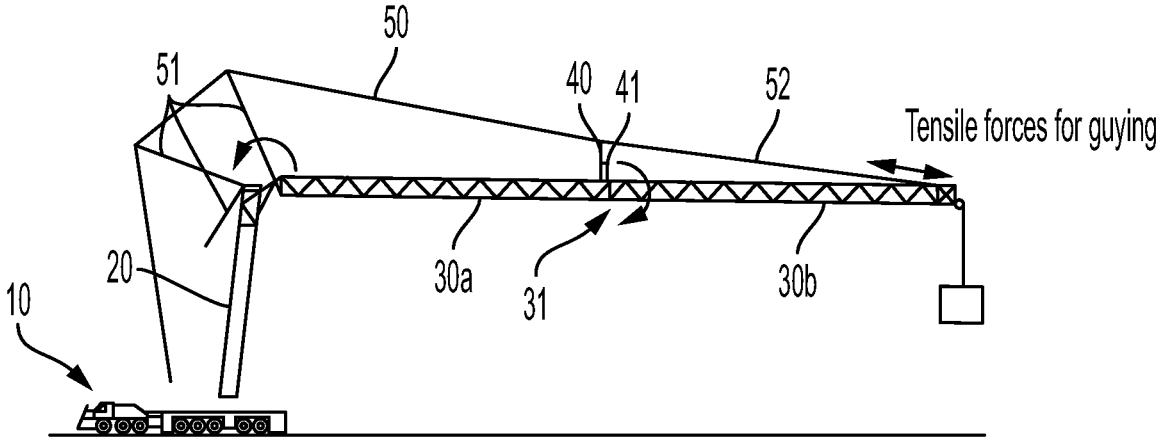
FIG. 2: a sketched side view of the mobile crane in accordance with the invention with an installed intermediate guying frame and a completely raised or installed fly boom.

FIG. 2 shows a sketch of the mobile crane in accordance with the invention having a foldable fly boom 30. In a similar manner to the prior art, the mobile crane comprises a vehicle 10 and the telescopic boom 20 that is luffably installed at the vehicle 10 and that can be luffed up by lulling rams, not shown. The fly boom 30, that is in turn composed of the two fly boom parts 30*a*, 30*b*, is luffably installed at the head end of the telescopic boom 20.

The articulated connection between the fly boom parts 30*a*, 30*b* is marked by reference numeral 32. The intermediate guying frame 40, that is arranged in the end region of the first fly boom part 30*a* and that is additionally fixed in a torque-rigid manner to the first fly boom part 30*a*, can be recognized in the end region of the first fly boo part 30*a*. The guying 50 extends from the superstructure of the vehicle 10 along the main boom 20 over the raising frames 51 up to the intermediate guying frame 40. The guying 50 partly comprises stay poles, in particular in the region 50' between the raising frames 51 up to the intermediate guying frame 40 where they are fixedly bolted to the free end of the intermediate guying frame 40. In accordance with the invention, the guying 50 is extended from the intermediate guying frame 40 by the section 52 up to the head end of the fly boom part 30*b* and is there fixedly connected, in particular bolted, thereto. A complete guying of the fly boom 30 is thereby achieved in regular crane operation. A guyed boom system without a cantilever effectively results. The effect of the side stabilization by the guying up to the head of the fly boom to can be used, particularly with long fly booms, due to the torque-rigid intermediate guying frame 40.

The guying 50 can still be used to raise the fly boom 30 despite the extended guying 52 up to the free end of the fly boom 30. Accordingly, no additional actuators or drives within the guying are required. The intermediate guying frame 40 required for this purpose is formed by a bar that is rigid in compression and is configured either with torque rigidity at the rear fly boom part 30*a* of the boom 30 or—as shown in detail in FIG. 3—is installed in an articulated manner at the fly boom part 30*a*. The assembly of the intermediate guying frame at the first fly boom part is not necessarily restricted to a specific installation location. However, an installation of the intermediate guying frame at or close to the end of the first fly boom part, i.e., in the region of the join for the at least one fly boom part, is ideal. An assembly of the intermediate guying frame at the top flange 33 of the first fly boom part is preferred. An additional guying 41 is provided between the intermediate guying frame 40 and the fly boom part 30*a* to ensure the required torque rigidity. The double crank thereby formed prevents an unwanted folding over of the intermediate guying frame 40 to the rear in the direction of the telescopic boom 20 on an exertion of force on the guying 50. Alternatively, instead of the guying 50, a support could also be installed that is fastened to the fly boom part 30*a* on the other side of the intermediate guying frame 40, that is closer to the telescopic boom 20.

Figure 3:
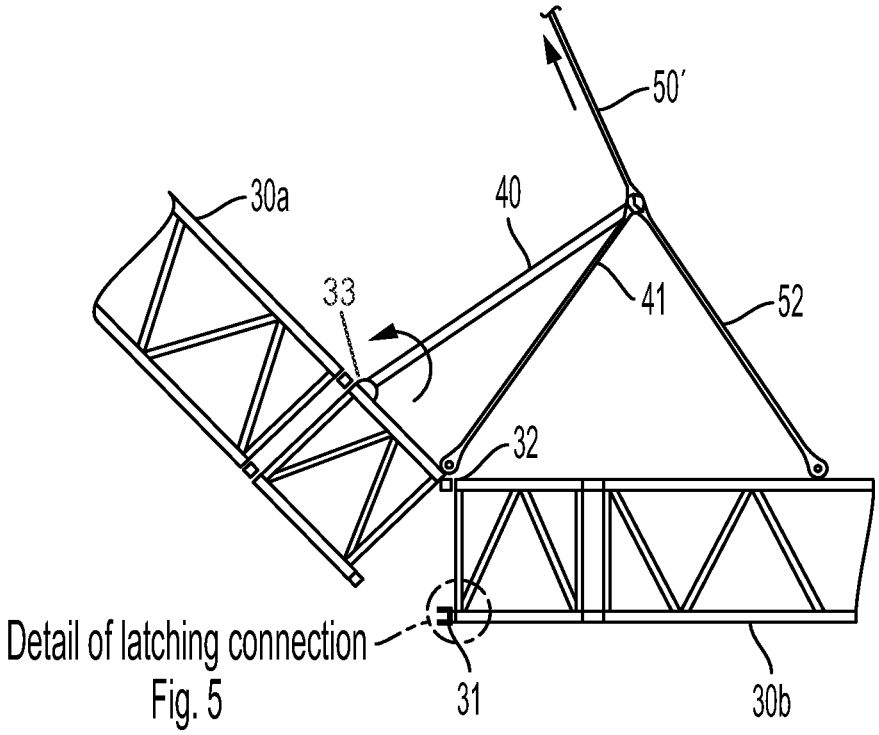
FIG. 3: a detail view of the join between the fly boom parts, including the intermediate guying frame.

The specific design of the double crank can be seen from the detailed illustration in FIG. 3 that is formed by the intermediate guying frame 40 having compressive rigidity and fastened in an articulated manner to the first fly boom part 30 and the additional linkage 41. A folding down of the intermediate stay pole 40 to the rear in the direction of the telescopic boom 20 is thereby prevented due to the geometry. The stay pole 50', that starts from the raising frame 51 and that is bolted to the stay pole 40 at the end side, is equally recognizable in the detailed illustration of FIG. 3. The same applies to the additional stay pole 52 that is bolted to the intermediate stay pole 40, on the one hand, and to the most extreme end of the second fly boom part 30*b*, on the other hand.

The pivot joint 32 between the two fly boom parts 30*a*, 30*b* and the mount 31 for the reception of the matching counterpart at the first fly boom part 30*a* can equally be seen from the detailed illustration.

To raise the fly boom 30, the guying winch at the superstructure of the vehicle 11 is wound up, whereby the rope arrangement disposed between the first raising frame 51 and the guying winch is shortened. The tension thereby applied is transmitted from the raising frames 51 up to the intermediate guying frame 40 to the first fly boom part 30*a*, whereby the latter is upwardly pivotable about a horizontal axis with respect to the main boom 20. The front part 30*b* having the still non-guyed guying 52 dan, as with the previous cantilever system, fold down until the joins 31 engage into one another and the latching device latches. When a load is suspended, new conditions are adopted that lead off some of the forces over the guying 50 at the head of the front part 30*b*. For this purpose, the length ratios of the guying 50 and of the lattice pieces of the fly boom 30 have to be coordinated with one another. Only in this way can a distribution of the forces and torques be achieved that is as good as possible.

Figure 4:
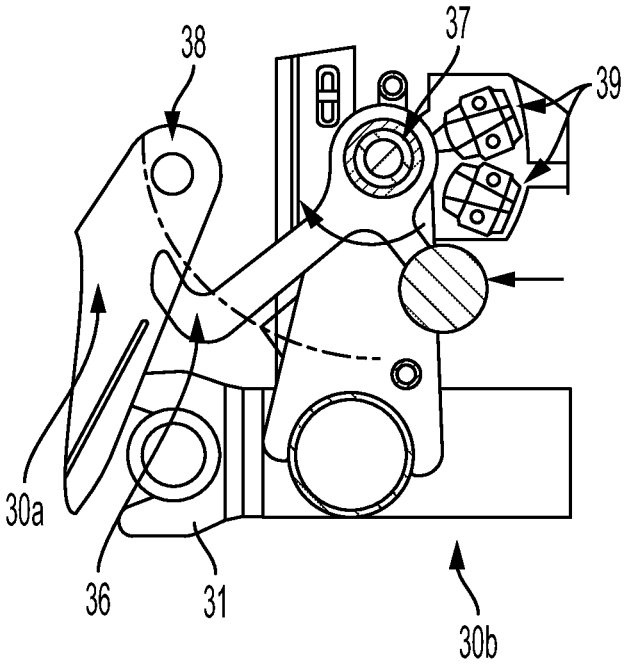

The latching device can be seen in detail from FIG. 4. The first fly boom part 30*a* and the second fly boom part 30*b* can be seen here. The latter carries the latching device having the latch 36 that is pivotably supported at the fly boom part 30*b* by means of a pivot joint 37. On the closing of the join 31 between the fly boom parts 30*a*, 30*b*, the latch 36 pivots up and engages around the bolt 38 of the first fly boom part 30*a*, whereby the join 31 is additionally secured against tension forces. A sensor system 39 detects the latch state and reports it to the crane control.

To ideally support a spectrum of conceivable fly boom conditions that is as wide as possible with the intermediate guying frame 40, this frame 40 can be adjustable in length. This can be implemented, for example, by pipes that are guided into one another and that can be bolted to one another at different positions. An adaptation of the length of the guying 41 between the intermediate guying frame 40 and the fly boom part 30*a* is equally optionally required. The most varied configurations of the fly boom 30, in particular different combinations of standard lattice pieces, can thereby be ideally used simply and without any additional parts or only minimally more parts.

The progression of the raising procedure of the boom system of the mobile crane in accordance with the invention will be briefly explained with reference to the illustrations of FIGS. 5A-5F: that reproduce the individual method steps chronologically.

Figure 5A:
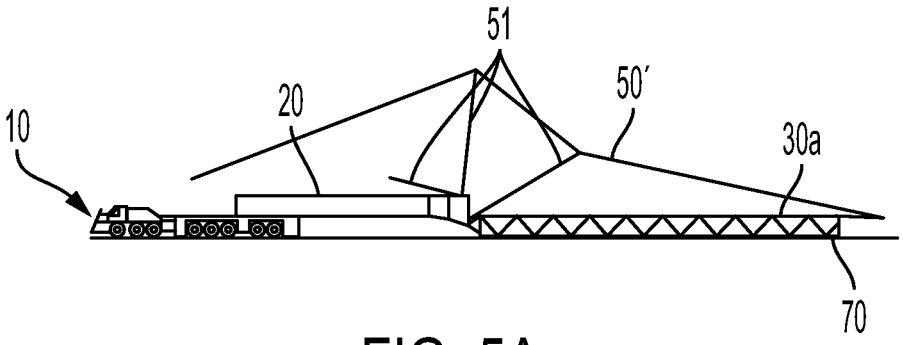
FIGS. 5A-F: a chronological sequence of the raising process for the fly boom of the mobile crane in accordance with the invention.

In the first step, the assembly of the first fly boom part 30*a* at the main boom 20 takes place close to the ground. The head of the first fly boom part is supported either on rollers or on a trolley 70 in this process. At the same time, the attachment of the intermediate guying frame 40 to the first fly boom part 30*a* can take place and the stay poles 50' can be installed. This is shown in FIG. 5A.

Figure 5B:
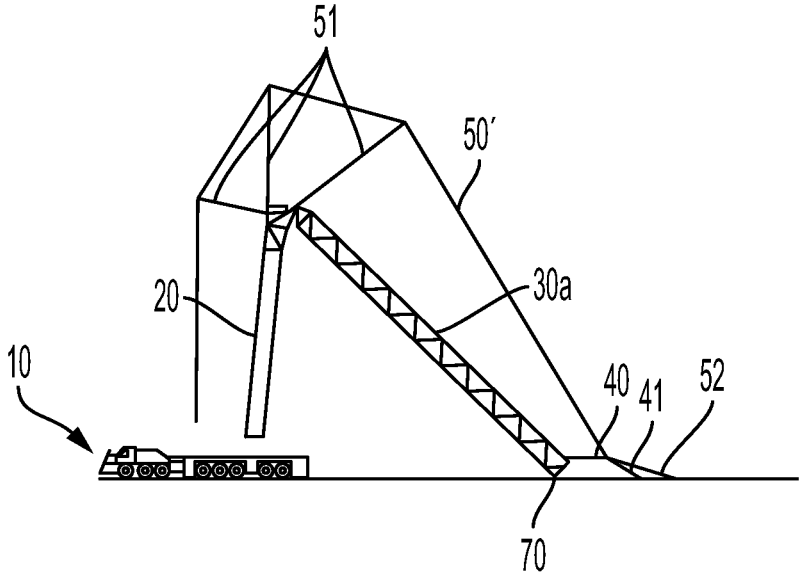

In the second method step in accordance with FIG. 5B, the telescopic boom 20 is first luffed up by means of the luffing ram and the frame guying 41 and the extended guying region 52 can be assembled starting from the intermediate guying frame 40 in the direction of the not yet assembled second fly boom part 30*b*.

Figure 5C:
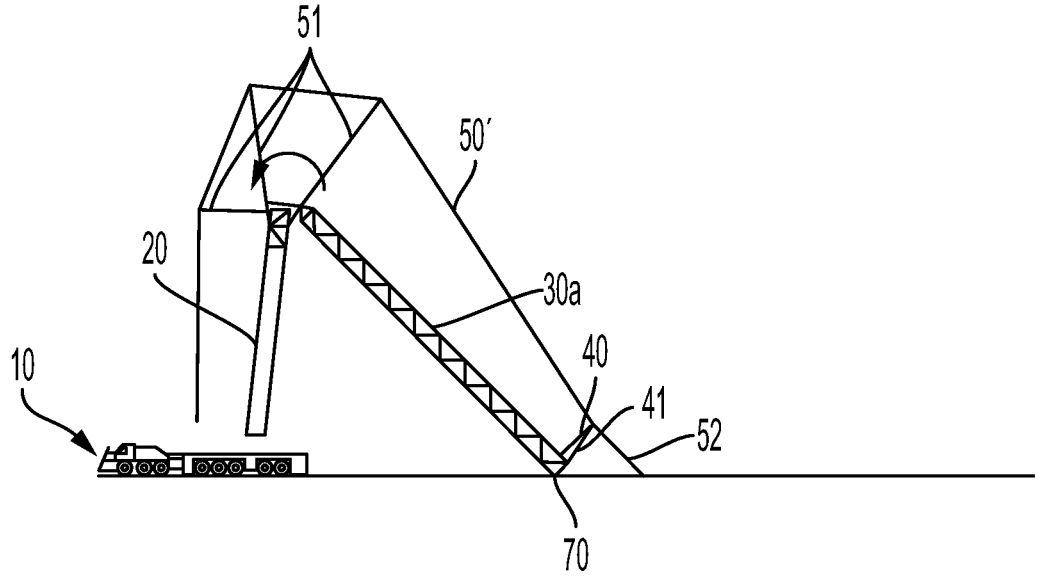

In the next step, the intermediate guying frame 40 can be luffed up and can be luffed up into the required position perpendicular or almost perpendicular to the longitudinal axis of the fly boom 30*a*. The separate frame guying 41 is then suspended for the fixing of the intermediate guying frame 40 (FIG. 5C).

Figure 5D:
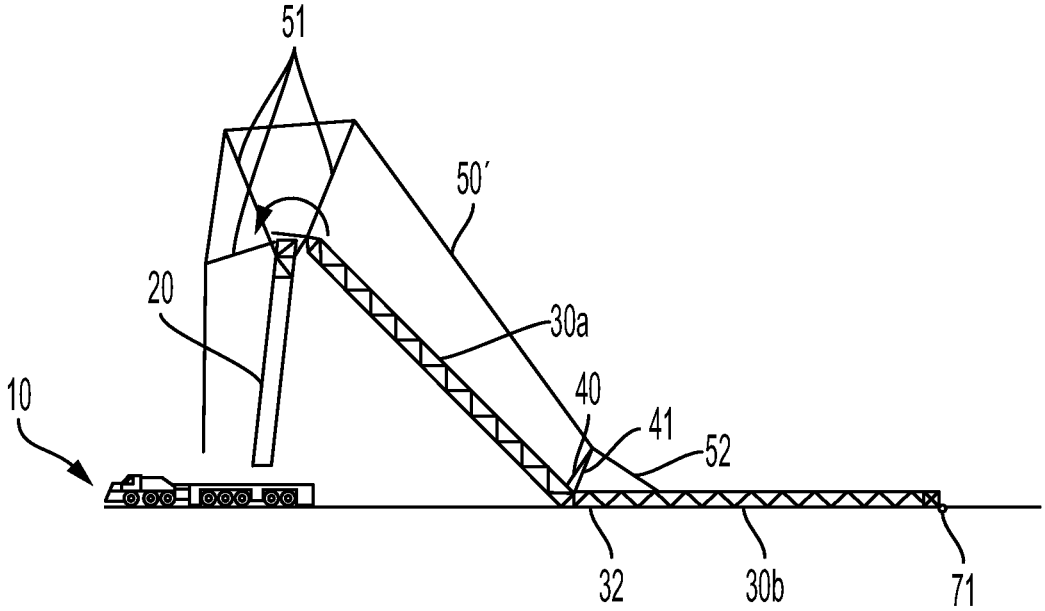
Figure 5E:
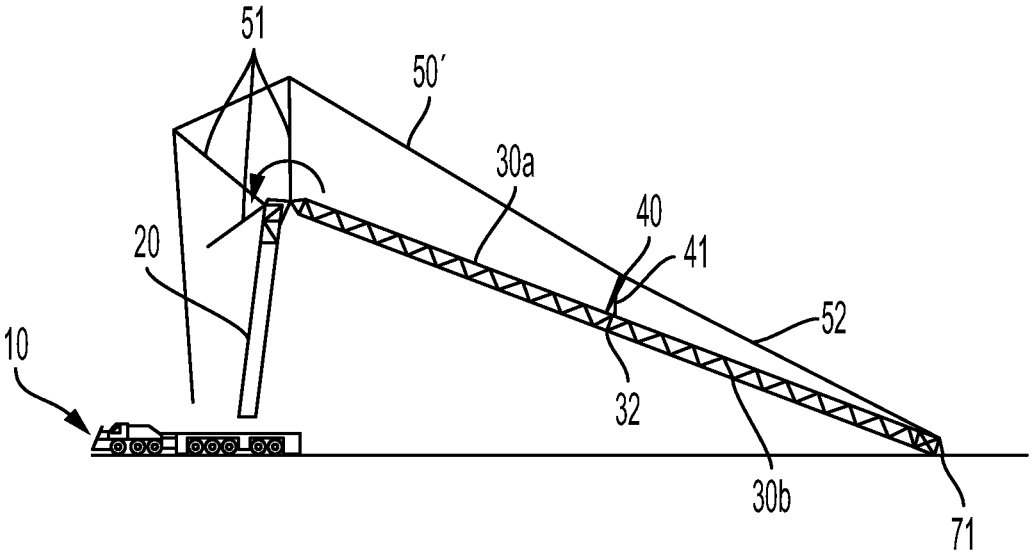

In the next step in accordance with FIG. 5D, the first fly boom part 30*a* is luffed up a little via the guying 50' to be able to assemble the second fly boom part 30*b* at the pivot point 32. The roller/trolley 71 then serves the support of the tip of the fly boom part 30*b*.

Figure 5F:
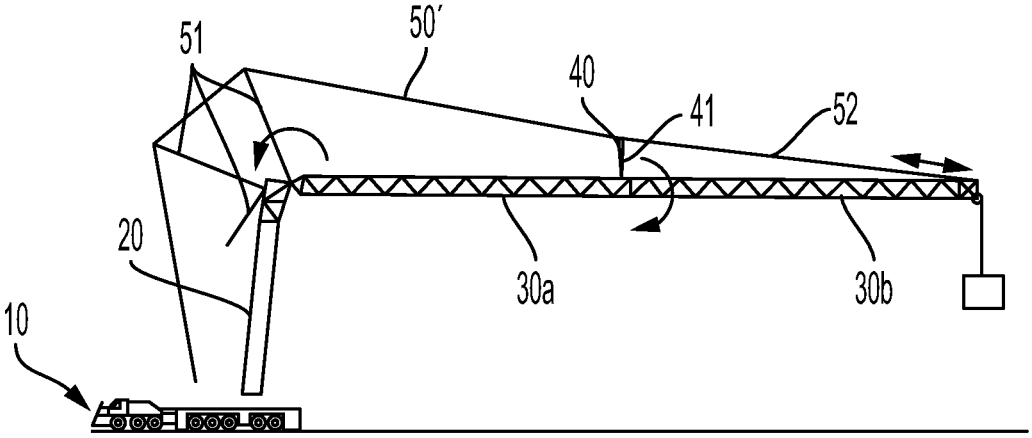

The assembly of the guying 52 at the head of the fly boom 30*b* then takes place. Work continues with the luffing up of the first fly boom part 30*a* (FIG. E) until the second fly boom part 30*b* lowers down due to gravity and the join 31 between the fly boom parts 30*a*, 30*b* is completely closed. This likewise comprises the latching of the latching device by pivoting the latch arm 36 inward. Finally, the assembled fly boom 30 is then fully luffed up (FIG. 5F).

The invention claimed is:

1. A mobile crane having a multi-part fly boom, wherein a first fly boom part is luffably connected to a main boom in an articulated manner and at least one second fly boom part is fastened to the first fly boom part in the articulated manner, and a guying guided from a superstructure up to the multi-part fly boom is provided for raising the multi-part fly boom, wherein the guying extends over at least one intermediate guying frame installed at the first fly boom part up to the at least one second fly boom part, wherein the guying is fastened to a head or to a head region of a second fly boom part of the at least one second fly boom part, wherein a latching device is provided at a connection point of the first fly boom part to the at least one second fly boom part that ensures an automatic latching during a raising procedure, the latching device is provided at the at least one second fly boom part, and wherein the latching device comprises a pivotable latch that automatically engages around a bolt of the first fly boom part.

2. The mobile crane in accordance with claim 1, wherein the intermediate guying frame is fastened with torque rigidity to the first fly boom part.

3. The mobile crane in accordance with claim 1, wherein the intermediate guying frame is connected to the fly boom in the articulated manner and wherein the intermediate guying frame is alignable or aligned in a torque-rigid manner via at least one separate frame guying.

4. The mobile crane in accordance with claim 3, wherein the intermediate guying frame and the separate frame guying form a double crank that is fastened to the first fly boom part.

5. The mobile crane in accordance with claim 3, wherein the guying frame comprises an adjustment means for setting a guying frame length or guying length.

6. The mobile crane in accordance with claim 5, wherein the adjustment means comprises a telescopic mechanism.

7. The mobile crane in accordance with claim 5, wherein the separate frame guying comprises an adjustment means for setting a guying frame length or guying length.

8. The mobile crane in accordance with claim 3, wherein the guying and/or the frame guying is/are bolted to a free end of the guying frame.

9. The mobile crane in accordance with claim 1, wherein the intermediate guying frame is installed at the first fly boom part in a region of a join for at least one fly boom part.

10. The mobile crane in accordance with claim 9, wherein the region of the join is a top flange of the first fly boom part.

11. The mobile crane in accordance with claim 1, wherein the intermediate guying frame can be moved into a transport position for a crane transport.

12. The mobile crane in accordance with claim 11, wherein the intermediate guying frame can be folded onto the multi-part fly boom for transport purposes.

13. A method of raising a boom system in a mobile crane in accordance with claim 1 comprising these steps:

a. Assembly of the first fly boom part, including raising frames at the main boom, the guying, and the intermediate guying frame at the first fly boom part;

b. luffing of the main boom and assembly of additional guying or guying bars;

c. minimal luffing of the fly boom and assembly of the at least one second fly boom part and fastening of the additional guying to the head part of the fly boom; and d. luffing the fly boom up to a geometrical closing of a latch connection between the first and second fly boom parts.

14. The method in accordance with claim 13, wherein the head of the fly boom is guided on ground on at least one trolley or roller during the raising procedure.

15. The method in accordance with claim 13, wherein, after the luffing up of the main boom, the intermediate guying frame installed in the articulated manner is luffed up.

16. The method in accordance with claim 15, wherein a frame guying is installed.

* * * * *